US008695247B1

(12) United States Patent
Yang

(10) Patent No.: US 8,695,247 B1
(45) Date of Patent: Apr. 15, 2014

(54) CANDLE-SHAPE DECORATIVE LAMP

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 0 days.

(21) Appl. No.: 13/831,627

(22) Filed: Mar. 15, 2013

(51) Int. Cl.
*G09F 13/00* (2006.01)

(52) U.S. Cl.
USPC ..... 40/442; 40/406; 40/407; 362/101; 362/318; 362/96; 362/806

(58) Field of Classification Search
USPC ..... 40/406, 407, 442; 362/101, 318, 96, 362/806
See application file for complete search history.

(56) References Cited

U.S. PATENT DOCUMENTS

| | | | | |
|---|---|---|---|---|
| 201,864 | A * | 4/1878 | Behn, Sr. | 368/93 |
| 6,604,835 | B2 * | 8/2003 | Zale | 362/101 |
| 6,862,824 | B1 * | 3/2005 | Hermanson et al. | 40/427 |
| 7,040,950 | B1 * | 5/2006 | Chen | 446/267 |
| 7,645,049 | B2 * | 1/2010 | Finkle | 362/101 |
| 7,647,716 | B2 * | 1/2010 | Finkle | 40/406 |
| 2008/0112154 | A1 * | 5/2008 | Reichow | 362/96 |
| 2011/0110073 | A1 * | 5/2011 | Schnuckle et al. | 362/96 |

* cited by examiner

*Primary Examiner* — Shin Kim
(74) *Attorney, Agent, or Firm* — Leong C. Lei

(57) ABSTRACT

A candle-shape decorative lamp is disclosed, including: a aquatic lamp main body, a magnet-driven element, a buoy and a bottom base. The magnetic-driven element and the buoy are disposed inside the aquatic lamp main body. The bottom base is fixedly engaged to the conic aquatic lamp main body with at least a light-emitting element disposed inside as well as a magnetic rotational axis for correspondingly attaching to the magnet-driven element, and driven by a driving element to rotate. When the magnetic rotational axis rotates, the magnet-driven element also rotates because of attachment to the magnetic rotational axis so as to wave the fluid inside the aquatic lamp main body, which leading to pushing to rotational plats to rotate the buoy. As such, the light emitted through the aquatic lamp main body forming ambient light with decorative effect so as to great rich and fun visual effects.

2 Claims, 5 Drawing Sheets

CANDLE-SHAPE DECORATIVE LAMP

FIELD OF THE INVENTION

The present invention generally relates to a candle-shape decorative lamp, and more specifically to a decorative lamp with in a faux shape, and able to display dynamic visual effect.

BACKGROUND OF THE INVENTION

Candle is one of the oldest lighting devices. As a variety of lighting devices is developed, the candle is mostly used in creating an ambience, festive events and religious ceremonies. The candles used above are mostly in the shape of a stick, with little variations.

When a candle is burned, the candle is subjected to flame flickering because of the air circulation in the ambient. In addition, when the ambient wind may unintentionally put out the candle flame or even tip over the candle to cause potential danger. Therefore, the use of candle requires much cause, which is one of main issues for the designer to overcome.

Therefore, it is desirable to devise an electronic candle lamp, able to provide lighting as well as visual enjoyments so as to enhance the esthetics of the household.

SUMMARY OF THE INVENTION

The primary object of the present invention is to provide a candle-shape decorative lamp, including: an aquatic lamp main body, being a three-dimensional object formed by a light-transmittable hollow main body and a light-transmittable bottom cover, sealing a fluid with slightly high viscosity; a magnet-driven element, disposed inside the aquatic lamp main body, having a spherical bottom and radiating flip plates at the top; a buoy, having a surface forming a hollow cylinder disposed with a pattern, having a plurality of rotational plates disposed with interval at the top and the bottom of the buoy, the buoy being disposed inside the aquatic lamp main body; a bottom base, having an upward opening fixedly engaged to the aquatic lamp main body, being disposed with at least a light-emitting element corresponding to the bottom of the aquatic lamp main body, inside being disposed with a magnetic rotational axis correspondingly attached to the magnet-driven element, the magnetic rotational axis being driven to rotate by a driving element; a three-dimensional cover body, assembled and disposed to the top of the aquatic lamp main body; and a shade, being hollow and disposed over the top of the cover body and accommodating a light-emitting element inside; wherein when the magnetic rotational axis being in rotation, the magnet-driven element also rotating because of attachment to the magnetic rotational axis so as to wave the fluid inside the aquatic lamp main body, which leading to pushing to rotational plats to rotate the buoy so that the light emitted through the aquatic lamp main body forming ambient light with decorative effect so as to great rich and fun visual effects.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENTS

The foregoing and other objects, features, aspects and advantages of the present invention will become better understood from a careful reading of a detailed description provided herein below with appropriate reference to the accompanying drawings.

Figure 1:
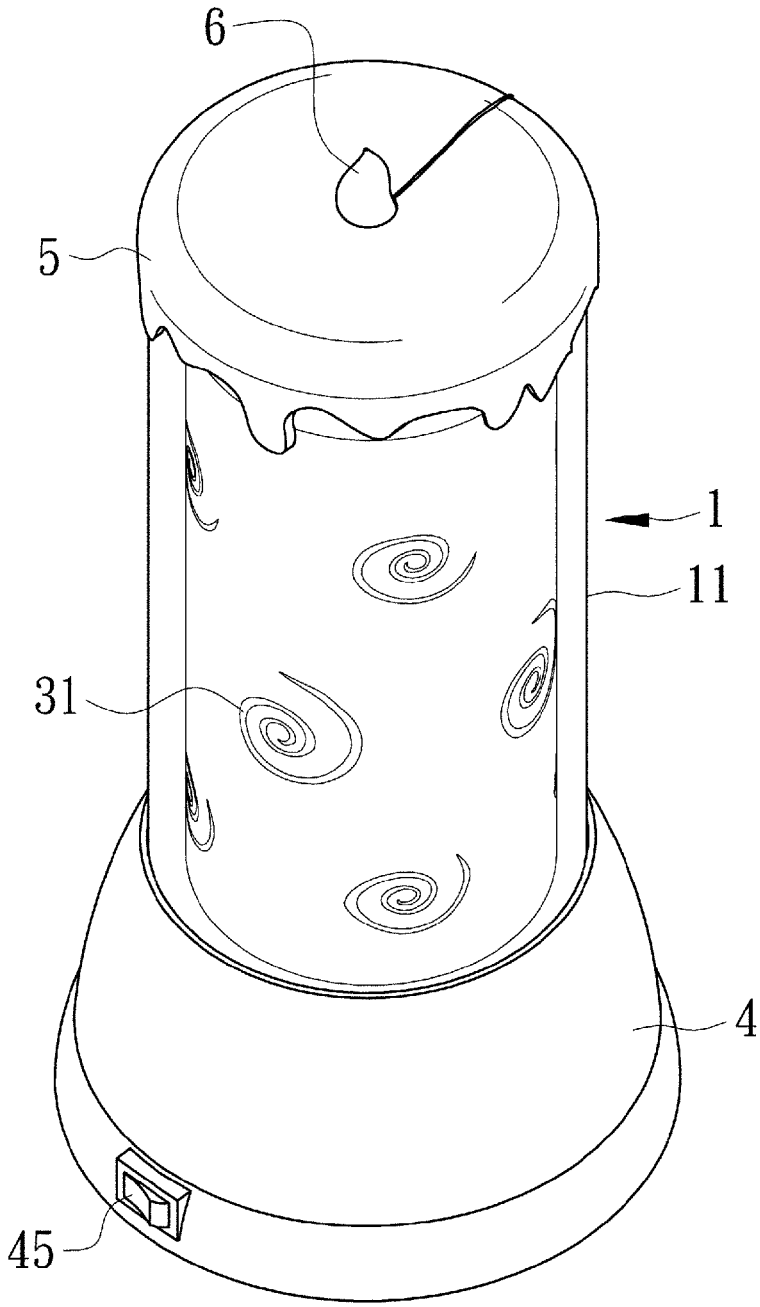
FIG. 1 shows a schematic view according to the invention.
Figure 2:
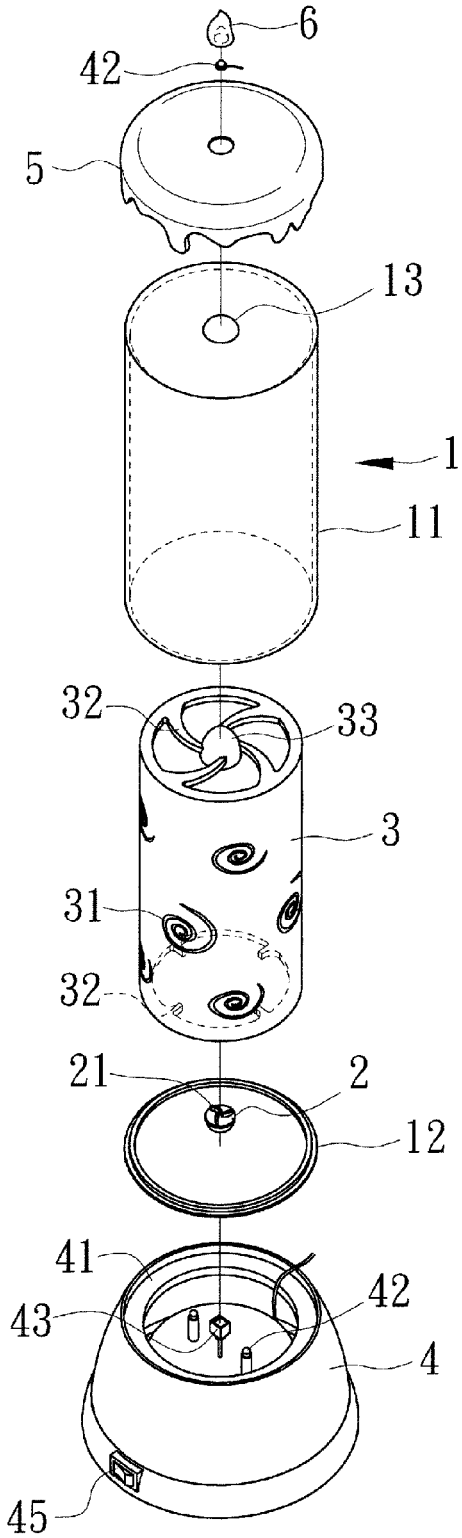
FIG. 2 shows a dissected view according to the invention.
Figure 3:
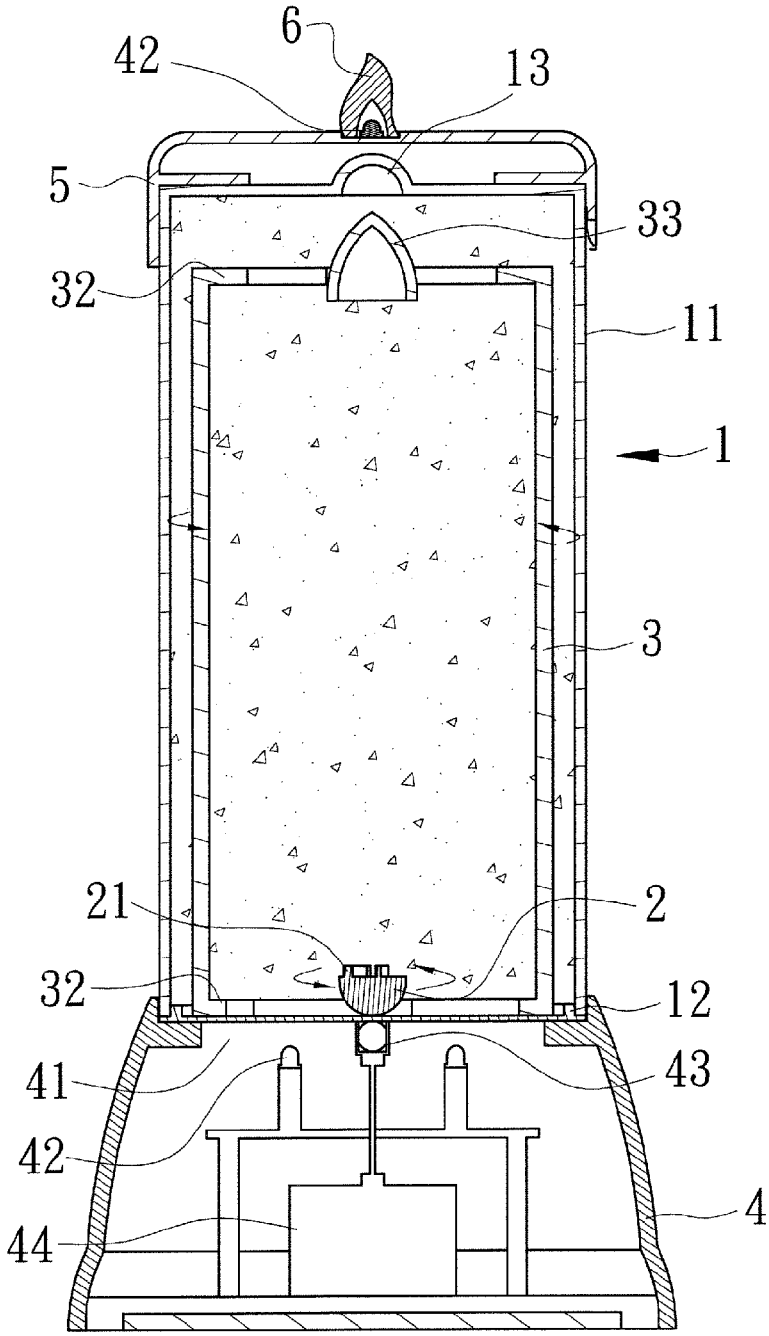
FIG. 3 shows a cross-sectional view according to the invention.

Refer to FIGS. 1-3, which are schematic view, dissected view and cross-sectional view of the present invention, respectively. The candle-shape decorative lamp mainly includes an aquatic lamp main body 1, a magnet-driven element 2, a buoy 3 and a bottom base 4. The aquatic lamp main body 1 is fixedly engaged to the top of the bottom base 4, with the magnet-driven element 2 and the buoy 3 being disposed inside the aquatic lamp main body 1.

The aquatic lamp main body 1 is a three-dimensional object formed by a light-transmittable hollow main body 11 and a light-transmittable bottom cover 12 sealing in a fluid with slightly high viscosity, doped with glittering particles or pieces. The main body 11 is disposed with an upward protruding hemispheric positioning trench 13 at the top.

The magnet-driven element 2 has spherical bottom and a flat top disposed with radiating flip plates 21. The magnet-driven element 2 is disposed inside the aquatic lamp main body 1.

The buoy 3 is disposed inside the aquatic lamp main body 1, is hollow with a pattern 31 on the surface. In the present embodiment, the buoy 3 is made of transparent material with a skeleton top and a skeleton bottom. A plurality of rotational plates 32 is disposed with intervals in a radiating form from wall of the top and bottom. A top pillar is disposed at the top corresponding to the positioning trench 13.

The bottom base 4 has an upward opening 41 fixedly engaged to the aquatic lamp main body 1. Two light-emitting elements 42 are disposed inside the bottom base to correspond to the bottom cover 12 of the aquatic lamp main body 1 for projecting light onto the light-transmittable aquatic lamp main body 1 to enhance the visual esthetics. A magnetic rotational axis 43 is disposed inside the bottom base 4 correspondingly attached to the magnet-driven element 2. The magnetic force of the magnetic rotational axis 43 is from a magnet, preferably a powerful magnet. The magnetic rotational axis 43 is driven by a driving element 44 to rotate.

The present invention may further include a three-dimensional cover body 5 and a flame-shape shade 6. The cover body 5 is assembled and disposed to the top of the aquatic lamp main body 1; and the shade 6 is hollow and disposed over the top of the cover body 6 to form a monolithic shape with the aquatic lamp main body 1. The shade 6 is further disposed with a light-emitting element 42 inside. The light-emitting element 42 is supplied with power and controlled for ON and OFF by the bottom base 4. In the present embodiment, the cover body 5, the shade 6, the aquatic lamp main body 1 and the bottom base 4, after assembly, form a candle shape.

Figure 4:
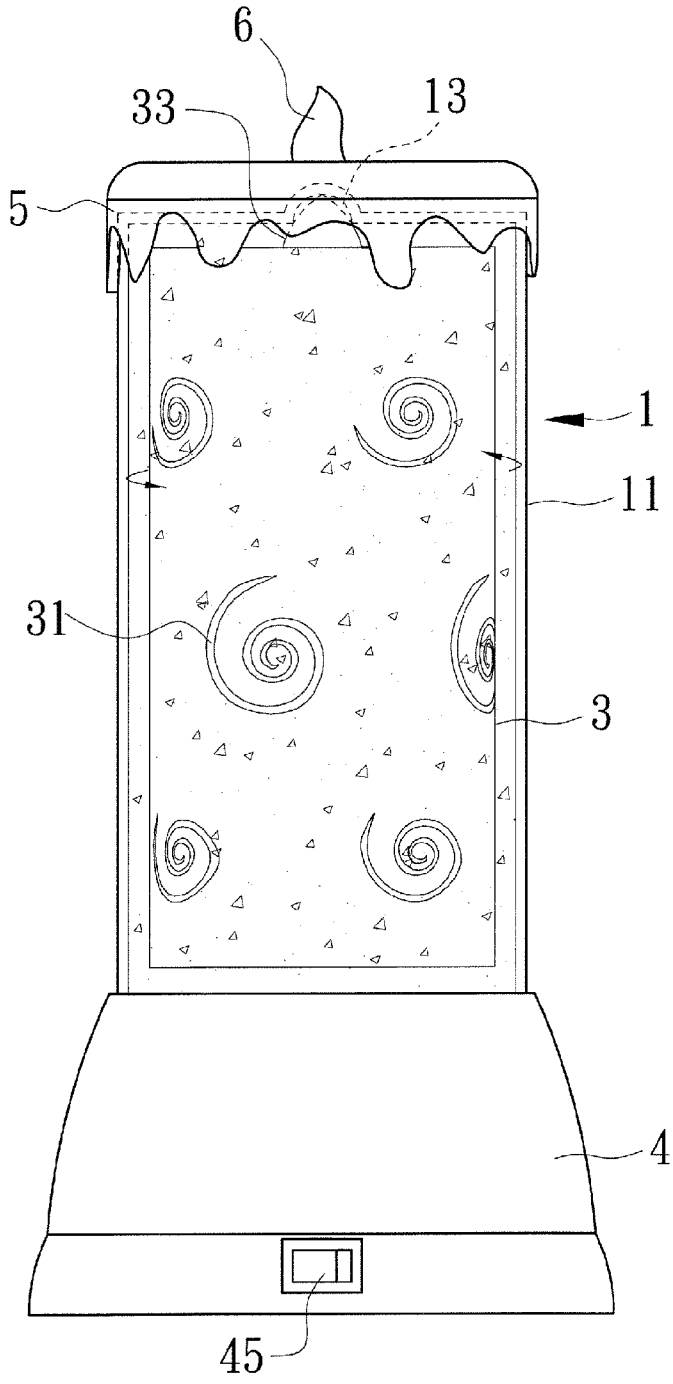
FIG. 4 shows a schematic planar view of operation according to the invention.
Figure 5:
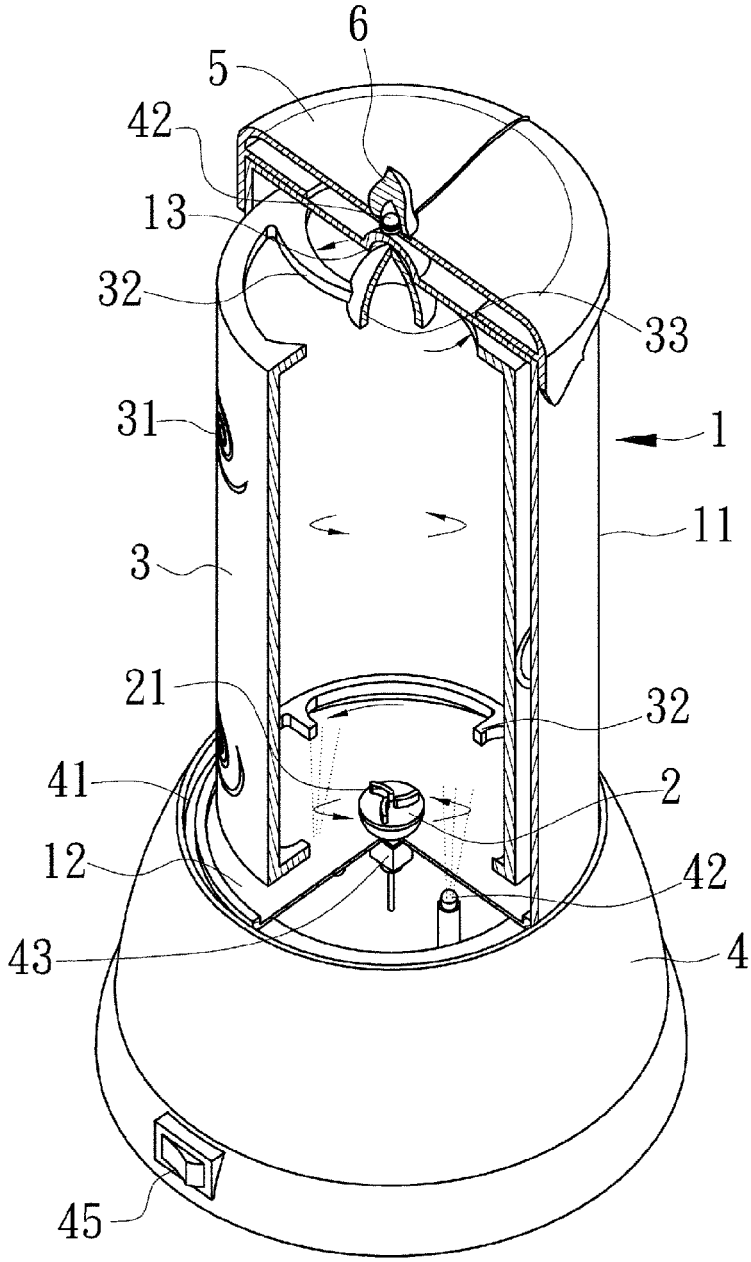
FIG. 5 shows a partial cross-sectional view according to the present invention.

Refer to FIG. 4 and FIG. 5. Because of the attachment of the magnetic rotational axis 43, the magnet-driven element 2 sinks at the bottom of the aquatic lamp main body 1, and the buoy 3 is carried by the force of the fluid inside the aquatic lamp main body 1 to stay floating, and using the top pillar 33 to fit the inside of the positioning trench 13 so as to limit the rational range of the buoy 3 inside the aquatic lamp main body 1.

In addition, the driving power for the light-emitting element 42 and the driving element 44 is controlled by a switch 45, and the power source can be corresponding battery or by other means of AC or DC, which is not within the scope of the present invention, and thus the detailed description is omitted here.

In the embodiment, the light-emitting element 42 can be designed as a light-emitting diode (LED), and is disposed correspondingly below the light-transmittable aquatic lamp main body 1 and inside the shade 6, to provide a variety of light colors to further enhance the visual effect of the present invention.

As such, when the magnetic rotational axis 43 rotates, the magnet-driven element 2 also rotates due to the attachment to the magnetic rotational axis 43 so as to wave the fluid inside the aquatic lamp main body 1. The fluid, in turn, pushes the rotational plates 32 at the top and the bottom of the buoy 3 so that the buoy 3 also rotates by the dragging of the fluid to display dynamic visual effects.

The specific operation of the present invention can be described as follows. An electrical power drives the light-emitting element 42 to laminate and the driving element 44 to operate, and then the magnetic rotational axis 43 rotates due to the driving of the driving element 43. The magnet-driven element 2 also rotates due to the attachment to the magnetic rotational axis 43 and uses the flip plates to wave the fluid inside the aquatic lamp main body 1 to flow in the same direction and to disturb the glittering particles or pieces doped in the fluid to flow along. The flowing fluid pushes the rotational plates 32 disposed on the buoy 3 to rotate the buoy 3. Therefore, under the luminance of the light-emitting element 42, the present invention can show a visual effect of a everlasting candle light to further enhance the effect.

In summary, the present invention shows features of progression and industrial utilization and the structure and the features of the present invention has never been publicly disclosed, thus, shows feature of novelty. Therefore, the present invention meets the requirements of patent application.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A candle-shape decorative lamp, comprising:

an aquatic lamp main body, being a three-dimensional object formed by a light-transmittable hollow main body and a light-transmittable bottom cover, sealing a fluid with slightly high viscosity;

a magnet-driven element, disposed inside the aquatic lamp main body, having a spherical bottom and radiating flip plates at the top;

a buoy, having a surface forming a hollow cylinder disposed with a pattern, having a plurality of rotational plates disposed with interval at the top and the bottom of the buoy, the buoy being disposed inside the aquatic lamp main body;

a bottom base, having an upward opening fixedly engaged to the aquatic lamp main body, being disposed with at least a light-emitting element corresponding to the bottom of the aquatic lamp main body, inside being disposed with a magnetic rotational axis correspondingly attached to the magnet-driven element, the magnetic rotational axis being driven to rotate by a driving element;

a three-dimensional cover body, assembled and disposed to the top of the aquatic lamp main body; and a shade, being hollow and disposed over the top of the cover body and accommodating a light-emitting element inside;

wherein when the magnetic rotational axis being in rotation, the magnet-driven element also rotating because of attachment to the magnetic rotational axis so as to wave the fluid inside the aquatic lamp main body, which leading to pushing to rotational plats to rotate the buoy so that the light emitted through the aquatic lamp main body forming ambient light with decorative effect so as to great rich and fun visual effects.

2. The candle-shape decorative lamp as claimed in claim 1, wherein the aquatic lamp main body is disposed with a upward protruding hemispheric positioning trench and the top of the buoy is disposed with a corresponding top pillar.

* * * * *